US005836189A

United States Patent [19]

Streubel et al.

[11] Patent Number: 5,836,189

[45] Date of Patent: Nov. 17, 1998

[54] METHOD OF MANUFACTURING A PIPE HAVING SECTIONS WITH DIFFERENT CROSS-SECTIONAL CONFIGURATIONS

[75] Inventors: Wolfgang Streubel, Detmold; Udo Klasfauseweh, Gütersloh, both of Germany

[73] Assignee: Benteler AG, Paderborn, Germany

[21] Appl. No.: 795,574

[22] Filed: Feb. 6, 1997

[30] Foreign Application Priority Data

Feb. 7, 1996 [DE] Germany ..... 196 04 368.9

[51] Int. Cl.[6] ..... B21D 39/02

[52] U.S. Cl. ..... 72/51

[58] Field of Search ..... 72/51, 52, 368, 72/379.2, 367; 228/170, 154, 144; 29/557

[56] References Cited

U.S. PATENT DOCUMENTS 4,455,855 6/1984 Hayashi ..... 72/51

*Primary Examiner*—Joseph J. Hail, III
*Assistant Examiner*—Rodney Butler
*Attorney, Agent, or Firm*—Friedrich Kueffner

[57] ABSTRACT

A method of manufacturing a pipe having sections with different cross-sectional configurations includes initially providing a sheet bar which has a rectangular base portion and at least one formation section integrally connected to the base portion. In the next step, the sheet bar is shaped into a hollow-cylindrical body. In this step, the base portion is deformed into a tubular shape and the formation section is deformed into a spiral shape. Subsequently, the final shaping of the pipe is carried out which may constitute widening of the formation section by a block which acts from the inside. In a subsequent joining procedure, abutting edges are connected.

5 Claims, 4 Drawing Sheets

METHOD OF MANUFACTURING A PIPE HAVING SECTIONS WITH DIFFERENT CROSS-SECTIONAL CONFIGURATIONS

BACKGROUND OF THE INVENTION

1. Field of the Invention

The present invention relates to a method of manufacturing a pipe having sections with different cross-sectional configurations.

2. Description of the Related Art

Welded pipes are manufactured from strip steel or sheet bars and are shaped into pipes and then welded along their joints. This results in hollow bodies having a round cross-section.

Pipes having expanded cross-sections at the ends thereof are frequently needed. These expansions are produced mechanically by widening the pipe end by means of a block and applying tensional forces and/or compression forces. However, the cross-sectional expansions which can be achieved in this manner are limited by the deformability of the material used for the pipes. Consequently, only relatively small geometric changes can be carried out. Also, widening frequently causes hardening of the material structure in the area where widening is carried out. This is undesirable in many cases because the hardening reduces the deformability of the material. For removing the structural changes, it is then necessary to carry out a complicated annealing treatment in order to ensure a sufficient ductility of the widened pipe ends for subsequent processing steps.

Additional processing is also required if the pipes have to be equipped with holders, brackets or the like. Such added components are usually secured to the pipe by welding after the pipe has been manufactured. This not only requires additional processing, but the required welding may cause subsequent structure changes of the material in the welding area.

SUMMARY OF THE INVENTION

Therefore, it is the primary object of the present invention to provide a method of manufacturing a pipe having sections with different cross-sectional configurations which is simpler and more economical than in the past, wherein particularly also the possibilities for shaping the pipe configuration are to be improved.

In accordance with the present invention, for manufacturing a pipe having sections with different cross-sectional configurations, initially a sheet bar is made available which has a rectangular base portion and at least one formation section integrally connected to the base portion. The sheet bar constitutes a layout having the accurate length of the outer circumferential surface of the pipe to be manufactured including any surface areas which project beyond the circumference of the pipe in the form of brackets or the like.

In the next step, the sheet bar is shaped into a hollow-cylindrical body. In this step, the base portion is deformed into a tubular shape and the formation section is deformed into a spiral shape. The longitudinal edges of the base portion are then located exactly against each other, while the sheet bar is coiled in the formation section with partially overlapping portions.

This deforming procedure can be carried out economically and with high accuracy in a die, wherein initially the sheet bar is shaped in a first partial step into a semicircular profile and, in another partial step, into the hollow-cylindrical shape.

Subsequently, the final shaping of the pipe is carried out, wherein suitable active means act on the formation section and produce the final geometry of the pipe.

The final shaping may constitute widening of the formation section by means of an active means, for example, a block, which acts from the inside. If a bracket projecting from the circumference of the pipe is to be formed, it is only necessary to align the formation section into the appropriate position.

In the subsequent joining procedure, the joints are connected. This is usually carried out by welding. Different methods are available for this purpose, such as laser welding, shielded arc welding, inductive welding or resistance welding.

The method according to the present invention produces a pipe having sections with different cross-sectional configurations, wherein harmful deformations or weakened areas of the pipe material in the areas of cross-sectional changes are avoided or occur only to an acceptable extent.

In accordance with another feature of the present invention, it is also possible to initially connect the abutting edges in the base area either entirely or partially before carrying out the final deformation. In the case of a complicated geometric configuration of a pipe, this may facilitate the further manufacturing steps.

The method according to the invention can be used particularly well for the manufacture of a pipe having a truncated cone-shaped cross-sectional expansion on at least one end.

For this purpose, a sheet bar is used which has a rectangular base portion, wherein a formation section having a trapezoidally-shaped configuration is connected to one end of the rectangular base portion. The sheet bar is of symmetrical construction with respect to its longitudinal plane. The sheet bar constitutes the layout of the circumferential surface of the pipe to be manufactured.

After the sheet bar has been deformed into a tubular hollow body, the final shaping of the pipe is carried out by widening the spirally coiled formation section in the form of a trumpet. This is advantageously carried out in a suitable mold by widening the end portion, so that this end portion is completely uncoiled and the final geometry of the stepped pipe is achieved. This is followed by the welding of the abutting edges.

By carrying out the above-described procedures, almost any type of cross-sectional expansions can be carried out in the end portions of a pipe. The deformability of the material used for the pipe is much less of a limitation to the shaping of the pipe than in the past. Hardenings of the material in the areas of expansions are minimized. Consequently, it is usually also unnecessary to carry out a thermal aftertreatment for equalizing disadvantageous material changes.

In accordance with an advantageous further development of the method according to the present invention, a sheet bar is used in which additional trapezoidally-shaped and/or rectangular formation sections are connected to the trapezoidally-shaped formation section. As a result, it is possible to widely vary the geometry of the end portions of a pipe.

In this manner, it is possible to manufacture pipes in which a portion widened in the shape of a trumpet can be followed by additional cylindrical or truncated cone-shaped portions.

In order to prevent the edges of the formation section from making direct contact during the step of coiling the sheet bar, the formation section may be provided with a ramp-shaped slide-on area. This is particularly advantageous if several formation sections of different geometry are to be joined together.

For example, a slide-on area can be formed by providing at the front end of the sheet bar a short trapezoidally-shaped attachment as an auxiliary surface. This auxiliary surface ensures that, due to an initially point-like contact, the sheet bar can be rolled up without problems.

However, it is also possible to form the slide-on area by forming a bend at an abutting edge of the formation section.

In accordance with another advantageous feature it is provided that, prior to deforming the sheet bar, the sheet bar is rolled intentionally with alternating thicknesses over sections thereof in rolling direction. If required, the rolled sheet bar is cut to the desired size before being further processed. The sheet bar produced for a specific purpose intentionally has varying thicknesses in order to provide various areas of the pipe formed from the sheet bar in accordance with the later use exactly with those wall thicknesses which are adapted to the respective loads, and, thus, to the peak stresses which during practical use differ from each other from location to location.

In this manner, it is possible to manufacture a pipe having sections with different cross-sectional configurations and sections having different wall thicknesses. The pipe having reduced wall thicknesses over portions thereof is particularly suitable for the manufacture of components which are subjected to extreme loads, wherein, however, the occurring stresses have different magnitudes over the length of the component as a result of the particular construction of the component. This is particularly frequently the case in motor vehicle components. If such components are designed to withstand the maximum load, this inevitably results in an overdimensioning of portions which are subject to lower loads. This not only means an increased material use, but also unnecessary weight. These disadvantages are now avoided by dimensioning the pipes which serve for manufacturing the components in accordance with the different loads occurring later in the individual portions of the component.

The rolling direction can basically be adapted to the respective configuration of the later pipe. The initial sheet bars can also be rolled partially twice or even several times in different directions. This makes it possible to vary the respective thicknesses in stages in accordance with the requirements. Rolling is advantageously carried out in two-high roll stand. By varying the geometry of the rolls at the roll entry, it is also possible to influence the symmetry with respect to the center transverse plane within certain limits.

The various features of novelty which characterize the invention are pointed out with particularity in the claims annexed to and forming a part of the disclosure. For a better understanding of the invention, its operating advantages, specific objects attained by its use, reference should be had to the drawing and descriptive matter in which there are illustrated and described preferred embodiments of the invention.

BRIEF DESCRIPTION OF THE DRAWING

In the drawing:

FIG. 4 also shows in broken lines the layout of the end section;

DETAILED DESCRIPTION OF THE PREFERRED EMBODIMENTS

Figure 1:
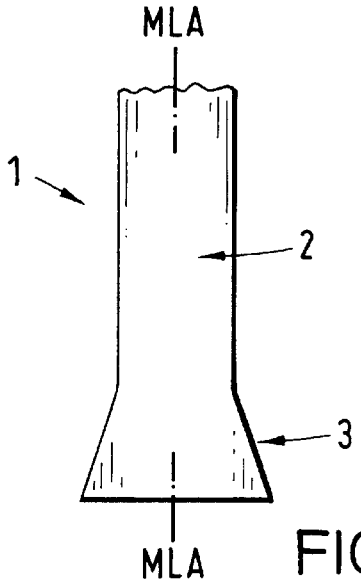
FIG. 1 is a top view of a portion of a sheet bar to be used for a pipe having an expanded end.

FIG. 1 of the drawing shows a portion of a sheet bar 1 which is used for manufacturing a pipe having an expanded end. The sheet bar 1 has a rectangular base portion 1 to which is connected a trapezoidally-shaped formation section 3. The sheet bar 1 is constructed symmetrically relative to its center longitudinal axis MLA and represents a layout of the pipe to be manufactured having the accurate length.

Figure 2:
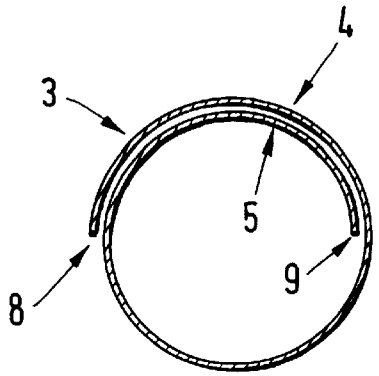
FIG. 2 is a vertical cross-section through a spirally rolled formation section.

The sheet bar 1 is then deformed with the use of the appropriate technological means into a hollow cylindrical body. The formation section 3 is coiled spirally, as illustrated in FIG. 2. This result in an overlapping of the deformation section 3 in the areas 4 and 5.

Figure 3:
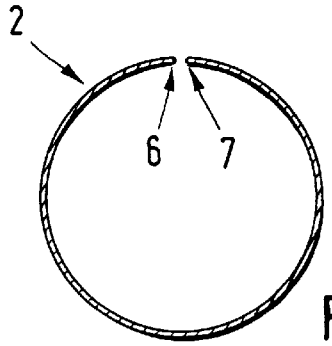
FIG. 3 is a vertical cross-section through the middle section rolled into the shape of a pipe.

FIG. 3 of the drawing shows the base portion 2 after being deformed into the shape of a pipe. The longitudinal edges 6 and 7 of the base portion 2 are then located opposite each other.

During final shaping, the hollow cylindrical body is secured into a suitable mold and the formation section 3 is provided with a block, so that the body is deformed into its final truncated cone-shaped geometry. By cutting the sheet bar precisely to the shape required for the pipe, it is achieved that the longitudinal edges 8 and 9 of the formation section 3 and the longitudinal edges 6 and 7 of the base portion 2 contact each other exactly.

The pipe is finished by welding the longitudinal edges 6, 7 and 8, 9 in a subsequent process step.

Figure 4:
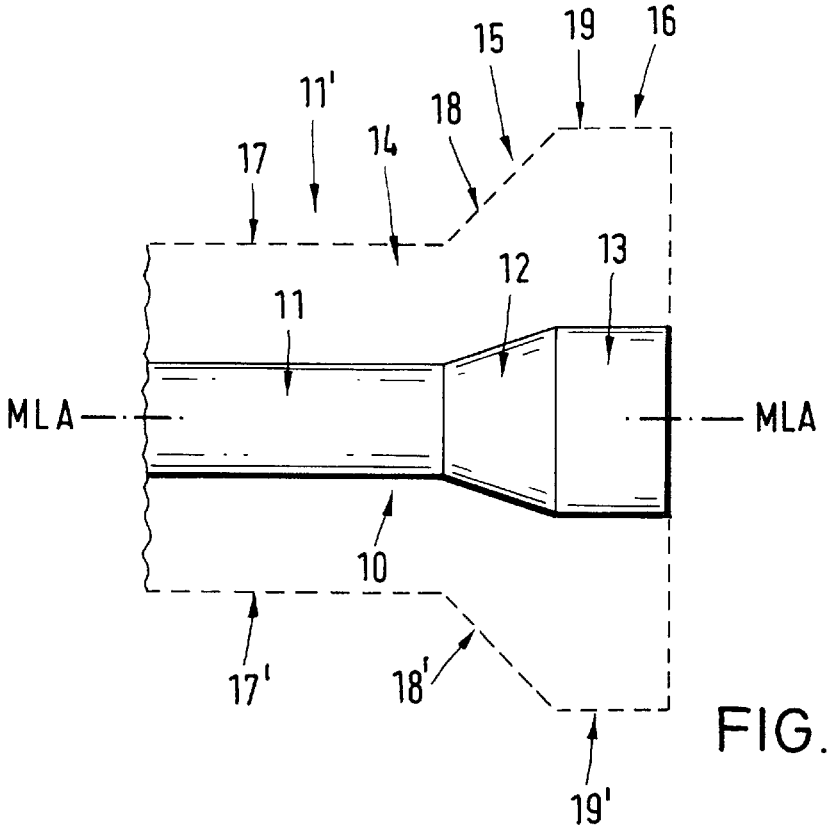
FIG. 4 is a top view of the end portion of a pipe with a truncated cone-shaped length section to which is joined a cylindrically-shaped length section.

FIG. 4 of the drawing shows the end portion of a pipe 10 having a cylindrical middle portion 11 to which is joined a truncated cone-shaped length section 12 and a cylindrically-shaped length section 13.

The pipe 10 is constructed symmetrically relative to the center longitudinal axis MLA.

The sheet bar 14 used for manufacturing the pipe 10 is shown in broken lines. The sheet bar 14 constitutes the layout of the circumferential surface of the pipe 10. FIG. 4 shows the rectangular base portion 11' to which is joined a trapezoidally-shaped deformation section 15 and another rectangular deformation section 16. By cutting the sheet bar accurately to size, it is ensured that the joints 17, 17', 18, 18', 19, 19' of the finally shaped pipe 10 exactly contact each other.

Figure 5:
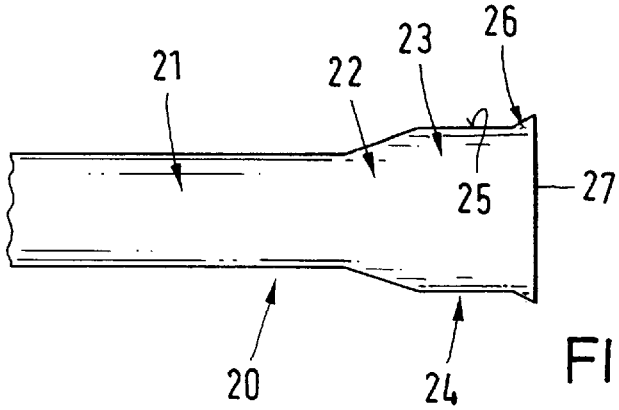
FIG. 5 is a top view of another embodiment of a sheet bar.

FIG. 5 of the drawing shows a sheet bar 20 with a rectangular base portion 21 as well as a trapezoidally-shaped deformation section 22 and another rectangular formation section 23. A ramp-like slide-on area 26 is provided in order to prevent the abutting edges 24, 25 of the formation section 23 from contacting each other when the sheet bar is rolled up. The slide-on area 26 is formed by a short trapezoidal attachment 27. The attachment 27 acts as an auxiliary surface and ensures that, due to the initial point-like contact, the rolling or coiling process of the sheet bar 20 can be carried out without problems.

Figure 6:
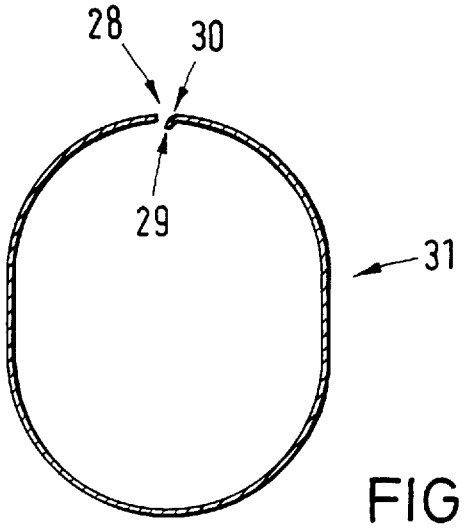
FIG. 6 is a vertical cross-section through a formation section with a bent end.

Another solution for aiding the coiling process is shown in FIG. 6. Thus, a slide-on area 28 is realized by a bent portion 29 at an edge 30 of a formation section 31.

Figure 7:
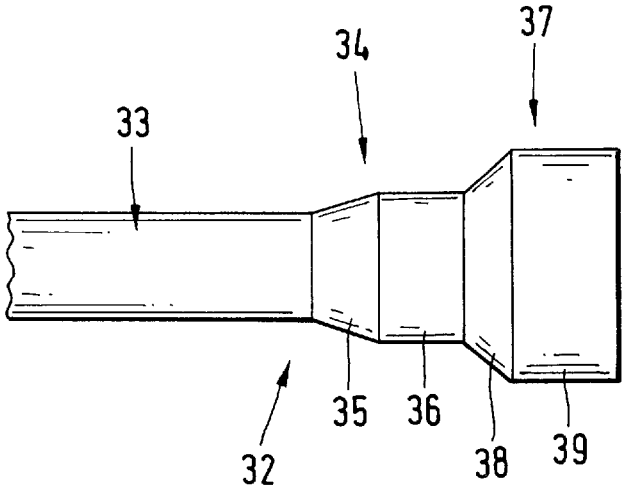
FIG. 7 is a top view of the end portion of a pipe having several steps.
Figure 8:
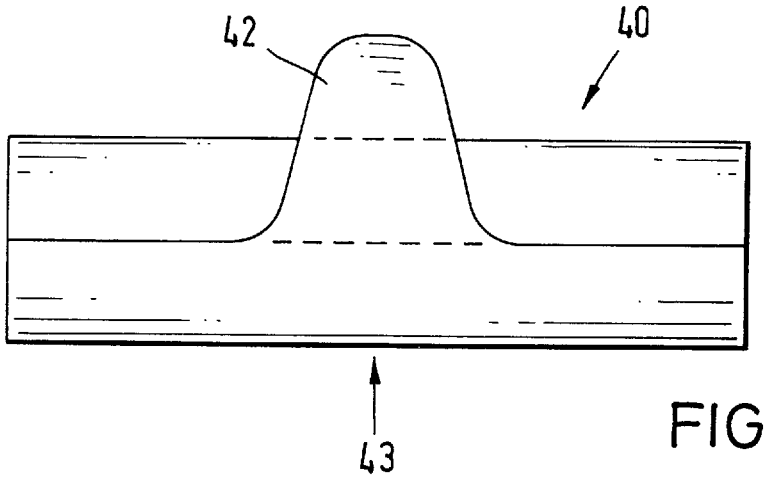
FIG. 8 is a top view of another embodiment of a pipe.
Figure 9:
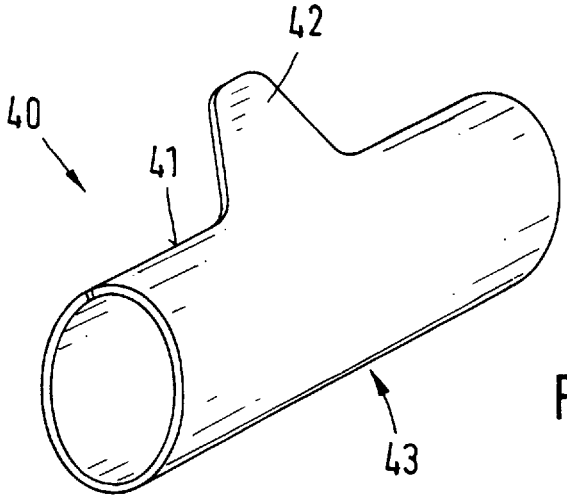
FIG. 9 is a perspective view of the pipe of FIG. 8.
Figure 10:
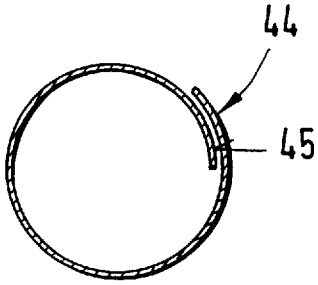
FIG. 10 is a vertical cross-section through the pipe of FIG. 8 prior to final shaping.
Figure 11:
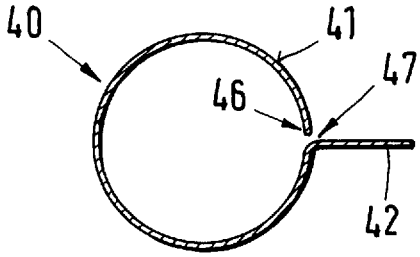
FIG. 11 is a vertical cross-sectional view of the pipe of FIG. 8 after final shaping.

The method according to the present invention makes it possible to simply and economically manufacture pipes having sections with different cross-sectional configurations. The number of steps can be varied depending on the application. FIG. 7 shows such a type of pipe 32 with several steps. The cylindrical middle portion 33 is followed by a step 34 composed of a truncated cone-shaped transition section 35 and a cylindrical length section 36. Another step 37 is formed by the truncated cone-shaped length section 38 and the cylindrical length section 39.

FIGS. 8 through 11 show a pipe 40 with a bracket 42 projecting from the periphery 41. The bracket 42 is arranged in the middle portion 43 of the pipe 40.

The sheet bar used for manufacturing the pipe 40 again includes a rectangular base portion to which is integrally connected the bracket 42 as a formation section 44. The sheet bar is then rolled up, so that the situation illustrated in FIG. 10 results. The formation section 44 is partially in contact with the circumferential surface 45 of pipe 40. For final shaping, the formation section 44 is placed in a suitable manner into the desired position so that the bracket 42 results.

Subsequently, the longitudinal edges 46 and 47 are welded.

Figure 12:
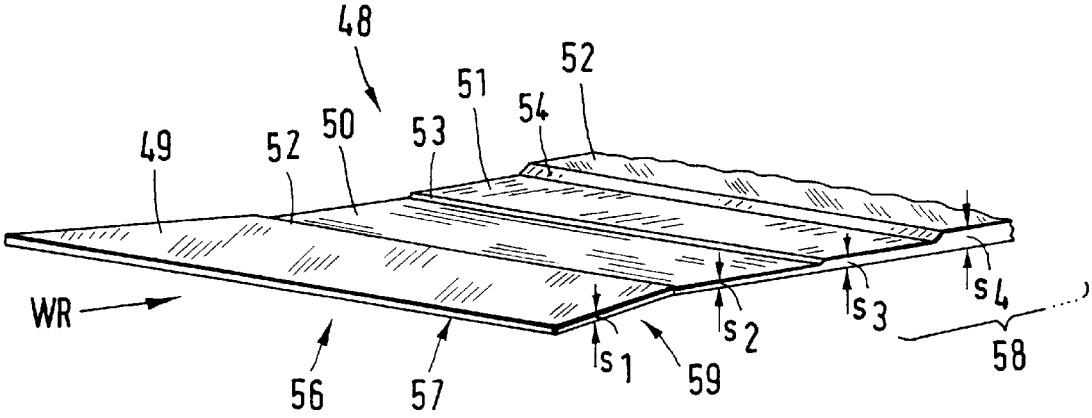
FIG. 12 is a perspective view of a portion of a sheet bar having different thicknesses over portions thereof.

FIG. 12 shows a portion of a sheet bar 48 which, as a result of rolling deformation, has been provided with sections 49 through 52 with thicknesses $s_1$, through $s_4$ which differ in rolling direction WR. At the transitions 53, 54, 55 the sections 49 to 52 are connected without steps. In the illustrated embodiment, the sheet bar 48 has an essentially smooth surface 59 at the bottom side 56. Of course, the sheet bar 48 may also be rolled on both sides.

The portions 50 to 52 form part of a rectangular base portion 58 of the sheet bar 48. The portion 49 has a trapezoidal configuration and forms the formation section 59 which is integrally connected to the base portion 58.

The sheet bar 48 can be used to manufacture a pipe having sections of different cross-sectional configurations and sections of different wall thicknesses $s_1$ to $s_4$. In the sheet bar 48 deformed in accordance with the specific use of the pipe, the sections 49 to 52 have precisely those thicknesses $s_1$ to $s_4$ which are adapted to the respective loads and stresses to which the sections 49 to 52 are subjected during practical use of the pipe manufactured from the sheet bar 48.

The invention is not limited by the embodiments described above which are presented as examples only but can be modified in various ways within the scope of protection defined by the appended patent claims.

We claim:

1. A method of manufacturing a pipe having sections with different cross-sectional configurations, the method comprising:

(a) making available a sheet bar having a rectangular base portion and at least one formation section integrally connected to the base portion, wherein the at least one formation section is configured differently from the base portion;

(b) deforming the base portion into the shape of a pipe and deforming the formation section into a shape with partially overlapping portions;

(c) deforming the sheet bar to a final shape of the pipe; and (d) joining together abutting edges of the base portion and the at least one formation section; further comprising using a sheet bar having a formation section of trapezoidal configuration at an end of the sheet bar and a symmetrical configuration with respect to a center longitudinal axis, whereby the pipe manufactured from the sheet bar has a truncated cone-shaped cross-sectional expansion on at least one end thereof.

2. The method according to claim 1, wherein the abutting edges of the base portion are at least partially joined together prior to final shaping.

3. The method according to claim 1, comprising using a sheet bar having additional at least one of trapezoidally-shaped and rectangular formation sections joined to the trapezoidally-shaped formation section.

4. The method according to claim 1, wherein a ramp-shaped slide-on area is formed on the formation section.

5. The method according to claim 1, comprising, prior to deforming the sheet bar, rolling the sheet bar with thicknesses which alternate as required in a rolling direction.

* * * * *